United States Patent [19]

Anahara et al.

[11] Patent Number: 4,620,413

[45] Date of Patent: Nov. 4, 1986

[54] METHOD OF YARN PIECING A SPINNING UNIT

[75] Inventors: Meiji Anahara; Kazuo Seiki, both of Kariya, Japan

[73] Assignee: Kabushiki Kaisha Toyoda Jidoshokki Seisakusho, Kariya, Japan

[21] Appl. No.: 540,825

[22] Filed: Oct. 11, 1983

[30] Foreign Application Priority Data

Oct. 15, 1982 [JP] Japan ..... 57-179952

[51] Int. Cl.[4] ..... D01H 15/02; D01H 5/28

[52] U.S. Cl. ..... 57/261; 57/22; 57/328

[58] Field of Search ..... 57/328, 22, 261, 263, 57/750

[56] References Cited

U.S. PATENT DOCUMENTS 3,992,865 11/1976 Tuchida et al. ..... 57/328

4,114,358 9/1978 Tsuchida et al. ..... 57/328

FOREIGN PATENT DOCUMENTS 35033 4/1978 Japan ..... 57/261

*Primary Examiner*—John Petrakes

*Attorney, Agent, or Firm*—Brooks Haidt Haffner & Delahunty

[57] ABSTRACT

A method of yarn piecing by splicing in a fasciated yarn spinning unit is disclosed herein, according to which an end of a fleece to be lapped over a broken end of a yarn is formed by stopping a preselected pair of drafting rollers and, if any, its preceding pair or pairs of drafting rollers, in response to a yarn-break signal. After a fleece end is thus prepared, the front top drafting roller is lifted from its bottom counterpart, and a broken yarn end on the yarn package is brought reversely through the false-twisting nozzle and on through a gap formed between the separated top and bottom rollers of the front pair. In order to allow the yarn end to overlap with the fleece end over the desired length, the lifted front top roller is brought back into pressing engagement with its bottom roller in close relation to the time at which the nip of the front pair of drafting rollers is reached by the fleece end which is advanced by restarting the previously stopped drafting rollers. The overlap of the ends is then moved into the false-twisting nozzle wherein it is pieced up under the effect of rotary streams of air.

8 Claims, 4 Drawing Figures

METHOD OF YARN PIECING A SPINNING UNIT

BACKGROUND OF THE INVENTION

The present invention relates generally to a method of yarn piecing in a spinning unit. More specifically, it relates to a method of yarn piecing in a spinning unit having a false-twisting nozzle operating in a pneumatic process for spinning a so-called fasciated yarn, said yarn piecing being accomplished by a so-called splicing method in which a broken yarn end and a mating end of a fiber bundle are pieced up together by interlacing the fibers thereof in the false-twisting zone of the nozzle.

A spun yarn which includes core fibers having substantially no twist and peripheral fibers whose ends bind the core fibers is popularly known as fasciated yarn, and the process for producing such a yarn as the fluid jet process. In this spinning process, fibers of sliver or roving are drafted into a strand or attenuated bundle of fibers by a drafting device comprising plural pairs of drafting rollers. The fibers thus drafted are then transferred into a false-twisting nozzle where they are false-twisted under the influence of rotary streams of fluid such as air as they are advanced continuously through a fiber passage channel formed through said false-twisting nozzle, whereby the bundle of fibers is transformed into a strand of spun yarn which includes, as stated in the above, the core fibers having substantially no twist and the peripheral fibers binding said core fibers.

This spinning process has achieved significant improvements in various respects; in particular, it has shown a remarkable increase in its spinning speed, accounting for much more than 100 m/min. However, this high-speed operation in turn poses a problem or disadvantage in the event of a break in the yarn which must be remedied by a yarn piecing operation. That is, it is extremely difficult, in a fasciated yarn spinning unit operating at a high speed, to allow a broken end of the yarn to overlap with a mating broken end of the fiber bundle in a way suitable for yarn piecing as it is customarily performed on a ring spinning unit for repair of a yarn break. Should piecing of the yarn be accomplished somehow, the resulting yarn may have a loose portion at the joint formed by the yarn piecing due to poor overlapping of the ends, which loose portion makes it difficult to form a yarn package of uniform winding.

Therefore, it has been a general practice in a fasciated yarn spinning unit to employ a knotting method so as to ensure positive yarn piecing, by which a broken yarn end is united by knotting the yarn end with an end of another yarn which is previously provided by twisting a fiber bundle. In this knotting method, however, the knot itself may cause a defect or drawback in the fabrics or knit goods produced in the subsequent weaving or knitting process.

A method which accomplishes yarn piecing by splicing is disclosed in Japanese Unexamined Patent Publication No. 53-35033 (1978), which method comprises the steps of transferring a broken end of the yarn from its package through a false-twisting nozzle in unwinding or reverse direction, holding the yarn end by a front pair of top and bottom drafting rollers, and lapping the yarn end over an end of a fiber bundle. According to this method, it is necessary for the end of the fiber bundle to be positioned correctly at the nip of the front pair of drafting rollers. For example, in the event of entanglement of the fiber bundle around a middle pair of aprons with consequent breaking of the bundle, the fiber bundle is no longer positioned correctly, thus causing failure of the yarn piecing and therefore inviting a decrease in working efficiency.

SUMMARY OF THE INVENTION

An object of the present invention is therefore to remove the above problems and disadvantages associated with a yarn piecing operation in a fasciated yarn spinning unit.

Another object of the invention is to provide a method according to which yarn piecing by splicing is accomplished with improved operational stability.

According to a preferred embodiment of a yarn piecing method of the present invention in a spinning unit which has a fiber drafting device including three pairs of top and bottom drafting rollers and in which the top roller of a front pair of said three pairs is independently liftable or disengageable from its associated bottom roller, a fleece or fiber bundle is broken at a point between the nips of the back and middle pairs of drafting rollers by stopping the back pair while allowing the middle and front pairs to continue their rotation, and the top front roller is then lifted up from its bottom counterpart. A broken end of the yarn is unwound from its package and transferred through the false-twisting nozzle and then past the lifted front top roller. The yarn end is held at a position adjacent to the lifted top front roller. In such an arrangement of the broken yarn and fleece ends, the fleece is advanced by restarting the stopped drafting rollers, while the top front roller is shifted back into a pressing engagement with its bottom roller at a time which is determined in close relationship with the length of yarn as measured from its held end to the nip point of the front drafting rollers, when engaged, and also with the time at which said nip point is reached by the advancing fleece end, so that an overlap of the ends over a desired length suitable for yarn piecing may be obtained. The overlap of the ends is then introduced into the false-twisting nozzle, where it is pieced up together by the false-twisting effect in the nozzle.

In this way, because the fleece is broken by the pulling action between the rotating and stationary pairs of drafting rollers, the broken end of the fleece will have the fibers thereat arranged in a uniform way suitable for yarn piecing by the splicing method. Furthermore, by precisely controlling the time at which the yarn end is allowed to advance, the ends to be united will overlap each other over a predetermined length that is most suitable for the desired yarn piecing results.

The above and other objects, features and advantages of the present invention will become more readily apparent to those skilled in the art from the following detailed description of a preferred embodiment according to the invention, taken in conjunction with the accompanying drawings, wherein:

DETAILED DESCRIPTION OF PREFERRED EMBODIMENTS

Figure 1:
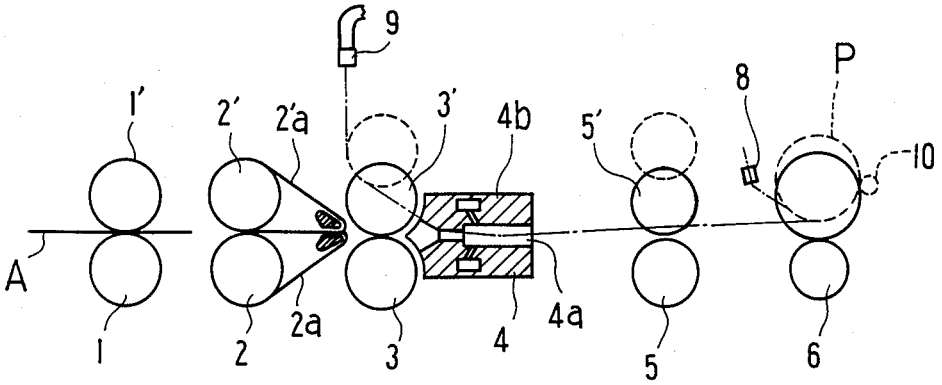
FIG. 1 is a side elevation showing a fasciated yarn spinning unit in which an embodiment of the invention may be carried out.

A fasciated yarn spinning unit, to which an embodiment of yarn piecing method according to the invention may be applied, is schematically illustrated in FIG. 1. The spinning unit comprises a drafting device including three succeeding pairs of top and bottom drafting rollers; namely, a back pair of rollers 1, 1', a middle pair of rollers 2, 2' having fiber guiding aprons 2*a*, 2'*a* installed thereround, and a front pair of rollers 3, 3', a false-twisting nozzle 4 disposed immediately ahead of said front pair of drafting rollers and having a fiber passage channel 4*a* extended therethrough, a pair of draw-off rollers 5, 5' one of which (the top draw-off roller 5' in the shown arrangement) is movable to and apart from its counterpart, and a take-up drum 6 engageable with a yarn package P for winding up a spun yarn.

In operation, fibers of sliver A which are fed from a supply source (not shown) are transferred to the drafting device, where they are drafted or attenuated to a fleece or ribbon-shaped fiber bundle of the required draft while they are passed through the nips of the succeeding pairs of drafting rollers, due to the increasing peripheral speeds of any two adjacent pairs of rollers. The fleece thus attenuated to the desired draft is then introduced into the fiber passage channel 4*a* of the false-twisting nozzle 4, where it is subjected to a false-twisting effect by the rotary stream of air caused by compressed air ejected from air jetting holes 4*b* (shown also in FIG. 2) into the channel 4*a*. Thus the fleece is transformed into a strand of fasciated yarn. The yarn is drawn out from the nozzle 4 by the draw-off rollers 5, 5' and wound up on a bobbin (not shown), which is driven by the take-up roller 6, into the package P.

In FIG. 1, the reference numeral 8 designates a yarn catcher for picking a broken yarn end from the package P and transferring the end to the outlet opening of the channel 4*a*; the numeral 9 a suction tube for holding the broken yarn end passed in reverse direction through the nozzle 4; and the numeral 10 an unwinding roller for rotating the package P in reverse or unwinding direction.

Figure 3:
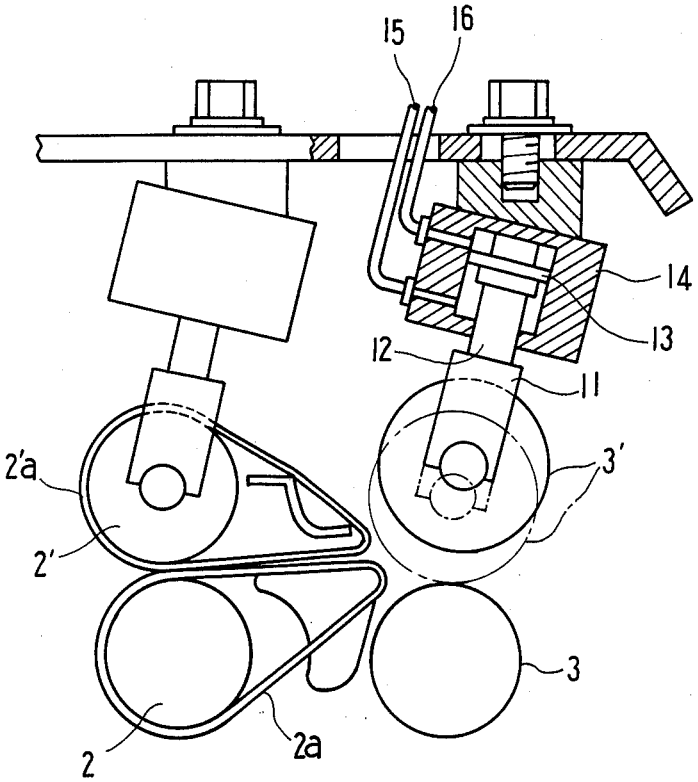
FIG. 3 is an enlarged partial sectional view of a drafting device used in the spinning unit of FIG. 1, illustrating a mechanism for lifting a top front drafting roller from its corresponding bottom roller.

In order to embody the present invention, the front top roller 3' is advantageously made liftable from its bottom counterpart 3 so as to disengage the nip and provide a gap therebetween, and also to restore the roller 3' to its normal pressing engagement with the roller 3 independently of the other pairs of drafting rollers. A lifting mechanism for this purpose is shown in FIG. 3, in which the front top roller 3' is rotatably supported by a holder 11 which is secured to a piston rod 12. A piston 13 is secured on the piston rod 12 and movable therewith in a double-acting cylinder 14 having two tubes 15, 16 connected to a compressed air source (not shown) via any suitable change-over means such as a solenoid valve (not shown). As is obvious from FIG. 3, when air under pressure is fed through the tube 15 into the lower compartment in the cylinder 14, the piston 13 is shifted upwards as shown, thereby to lift the top front roller 3' apart from its bottom roller 3. To replace the top front roller to its normal pressing position in engagement with the bottom roller, the solenoid valve is actuated so as to admit the compressed air into the upper compartment of the cylinder to move the piston downwards. Depending upon the embodiment of the invention, the lifting mechanism may be of a known pendulum arm type by which all the top drafting rollers may be lifted simultaneously from their associated bottom rollers.

Figure 4:
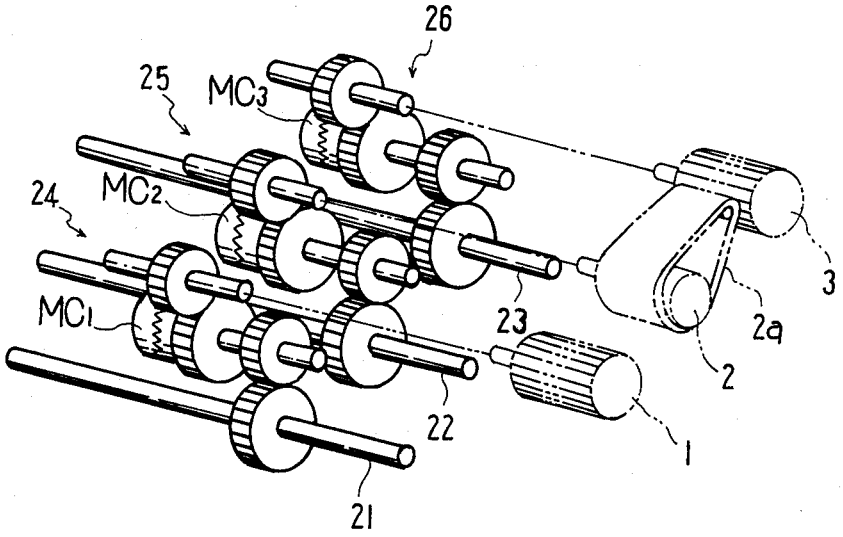
FIG. 4 is a partial perspective view showing a driving system for the drafting device.

As to the driving system of the drafting rollers, it is necessary, according to the invention, that each spinning unit should have its own drive system for its drafting rollers so that starting and stopping of the respective pairs of drafting rollers may be effected independently of the other spinning units. Furthermore, each of the bottom-side drafting rollers (or driven rollers) in each of the spinning units should preferably be driven by an independent line drive shaft, as exemplified in FIG. 4. That is, the bottom drafting rollers 1, 2 and 3 are respectively connected to their independent drive shafts 21, 22 and 23 through transmissions 24, 25, 26 which include electromagnetically-operated clutches MC1, MC2 and MC3 for controlling the engagement and disengagement of the respective bottom rollers with and from their drive shafts.

A preferred embodiment of a yarn piecing method according to the invention as applied to the above-described arrangement of a fasciated yarn spinning unit will be now explained with reference to FIG. 1.

As an initial step in yarn piecing, a fleece or bundle of drafted fibers should preferably have its fibers prepared in the drafting device so as to have substantially the same condition as when it is advanced in the drafting device during normal spinning operation. That is, in order to produce a pieced-up joint which is not conspicuous in the yarn, it is important that the end of the fleece to be lapped over the broken end of the yarn should have its fibers oriented uniformly and substantially straight in the longitudinal direction of the fleece and also be tapered toward its broken tip end. Accordingly, when a yarn break takes place in the spun yarn, the drafting rollers are allowed to continue to run under the same condition as during the normal spinning operation for a short predetermined interval of time, whereupon a preselected pair of drafting rollers (which preselected pair of rollers are referred to as the "reference pair" hereinafter) and its preceding pair or pairs, if any, disposed on the upstream side of said reference pair are stopped, while its succeeding pair or pairs of rollers on the opposite downstream side continue to run. Therefore, the fleece is forcibly torn off or broken at a point between the nip of the reference pair of stopped rollers and the nip of its immediately following pair of rotating rollers on the downstream side. Thus, the fleece is broken in such a way that its broken end may have straight and uniformly arranged fibers. In this initial step, fiber pieces or lints, if any, attached around the drafting rollers or aprons should preferably be removed therefrom prior to allowing the drafting rollers to run for the short given length of time.

In the embodiment illustrated in FIG. 1, the back pair of rollers 1, 1' are selected and used as the reference pair, and the fleece breakage takes place between the nips of the back and middle pairs of rollers. Its broken end is positioned between the back and middle pairs, accordingly, as clearly seen in FIG. 1. The fleece which has been separated by such breaking from the fleece remaining in the drafting device, may be discharged out from the front pair of rollers 3, 3' and removed for disposal thereof by any known means such as a pneumatically-operated clearer (not shown).

On the other hand, the broken end of the spun yarn is then positioned on the package P which is stopped on the take-up drum 6 in response to a yarn-break signal transmitted from any known yarn sensor (not shown). The yarn package P is lifted apart from the take-up drum 6 and driven instead by the unwinding roller 10 which rotates in a direction to unwind the yarn from the package. Simultaneously, the yarn catcher 8 locates and picks up the broken yarn end from the package P, and the draw-off roller 5' is then moved apart from its counterpart 5 to a position depicted by a dotted line, thereby providing a gap therebetween. The yarn end held by the catcher 8 is transferred through the gap between the draw-off rollers 5, 5' and further back to the outlet opening of the fiber passage channel 4*a* in the false-twisting nozzle 4 in which the supply of compressed air thereinto is then already shut off.

After the fleece has been broken off in the way as described earlier, the front top roller 3' is shifted up by the operation of the lifting mechanism (FIG. 3) to be separated from its associated bottom roller 3 to a position which is shown by a dotted line in FIG. 1, thereby providing a gap between the front pairs of drafting rollers 3, 3'. Then, a suction tube 9 provided on the upstream side of the nozzle 4 is moved to a position where its tip end opening confronts the inlet opening of the fiber passage channel 4*a* in the nozzle 4, so that the yarn end held at the opposite outlet opening is entrained by the air stream created in the channel 4*a* toward the inlet opening, and is therefore passed reversely through the channel. The yarn end is held by the suction tube 9 at the outlet and then brought between the top front roller 3' and the top apron 2'*a* to a position as shown in FIG. 1, whereby the end portion of the yarn extends from the inlet opening of the channel 4*a* past the top front roller 3', as shown by a phantom line.

With the broken fleece end positioned between the back and middle pairs of drafting rollers on the one hand and the broken end of the yarn held by the suction tube 9 on the other, the spinning unit is placed under a state of normal spinning operation; namely, the previously-stopped rollers are restarted to rotate, the top front roller 3' is shifted back into a pressing engagement with the bottom roller 3, the false-twisting nozzle 4 is energized again with the supply of compressed air, the draw-off rollers 5, 5' are engaged, and the yarn package P is driven by the take-up roller 6. In resuming the operation of the spinning unit, the time at which the top front roller 3' is brought into engagement with its bottom roller 3 (simultaneously the draw-off roller 5' is brought into contact with its counterpart draw-off roller 5) is established in close relation with the time at which the nip of the front pair of drafting roller 3, 3' is reached by the fleece end which is moved forward by restarting the back rollers 1, 1'. By so controlling, the broken yarn end may overlap the fleece end over a length suitable for interlacing the fibers thereof for optimum yarn piecing results.

This overlap section of the ends is united together while it is advanced in the fiber passage channel 4*a* of the false-twisting nozzle 4 under the influence of the rotary streams of air therein having the false-twisting effect.

As is understood from the foregoing, the above-mentioned time at which the front top roller 3' is pressed against the front bottom roller 3 should vary depending upon which pair of drafting rollers is selected and used as the reference rollers and also upon the length of the yarn from its held broken end and the point at which it is to be nipped by the front pair of rollers when in engagement. The following will therefore provide the descriptions of three different timings respectively corresponding to three different selections of the reference pair of drafting rollers.

Case 1: Front pair is selected as the reference pair:

All the drafting rollers are stopped, and fleece breakage takes place just ahead of the front pair of rollers. With the front top roller lifted from its bottom roller, the broken end of the fleece lies on the latter roller. Therefore, the lifted front top roller may be shifted back into pressing engagement with the bottom counterpart substantially simultaneously with, or prior to restarting of the stopped drafting rollers. The broken yarn end overlaps with the fleece end over a length $X_1$ which corresponds substantially to the length of the yarn extending from its held broken end to the nip of the front pair of drafting rollers when engaged. In this Case 1 wherein the front pair of drafting rollers is used as the reference pair, all the driving rollers may be rotated from a single drive shaft common thereto.

Case 2: The pair just preceding the front pair is selected as the reference pair:

In the drafting device exemplified in FIG. 1, its middle pair of drafting rollers 2, 2' corresponds to the reference pair in this Case 2. The fleece breaks at a point between the nips of the rotating front pair of rollers and the stopped reference pair of rollers. The front bottom roller continues to run. In order to obtain an overlap of the yarn and fleece ends similar to that in the above Case 1, pressing of the front top roller may be effected with a lag of time $Y_2$ elapsing before the nip of the front pair of drafting rollers, when in engagement, is reached by the end of the fleece advanced by having previously restarting the stationary drafting rollers.

In this Case 2, the pressing and restarting may be provided substantially simultaneously if the length $X_2$ of the yarn, extending from its held end to the nip of the front pair of drafting rollers, is made great enough so that the fleece end to be lapped over the yarn end may reach said nip before the yarn end is discharged out therefrom. In such a case, as would be apparent to those skilled in the art, a lifting mechanism of a known pendulum arm type may be employed which moves simultaneously all the top rollers apart from or to their associated bottom rollers, instead of the mechanism as exemplified in FIG. 3 for operating the top front roller 3' only. This is true of the preceding Case 1 wherein the pressing of the front top roller and restarting of the drafting rollers may be effected substantially at the same time.

Case 3: Back pair is selected as the reference pair:

The fleece end is positioned between the nips of the stopped back pair of rollers and its succeeding pair of rollers which continue to rotate, the latter pair corresponding to the middle pair of rollers 2, 2' in the three-line arrangement shown in FIG. 1.

In a fasciated yarn spinning unit, it takes generally about one second for the fleece end in the above position to move to the nip of the front pair of rollers, and the front rollers rotate a peripheral distance of about two meters in said one second. This means that unless a yarn end having a length of more than two meters is reserved by any suitable means such as the suction tube 9 or any storage means adapted for that purpose, it is practically impossible to make an overlap of the yarn and fleece ends over the desired length by simultaneous restarting of the stationary rollers and pressing of the front top roller. In this Case 3, therefore, it is desired that the front top roller should be made engageable and disengageable independently of the other top drafting rollers so that the pressing of the top front roller is provided with a predetermined lag of time $Y_3$ after restarting the stopped back rollers so that the desired length of overlap of the ends may be ensured for successful yarn piecing.

Below is provided a table showing the preferable range of the length X (cm) of the yarn end portion to be prepared on the upstream side of the false-twisting nozzle, as measured from its broken end to the nip of the front pair of drafting rollers when in engagement, and the range of the lag of time Y (second) with which the front top roller is pressed against its bottom counterpart after the stationary drafting rollers are restarted, in each of the three cases in which a different pair of rollers is selected as the reference pair:

| Reference Pair | X (cm) | Y (second) |
|---|---|---|
| Front pair | 2–30 | ≦0 |
| Middle pair | 5–100 | 0–½ |
| Back pair | 10–500 | 0–3 |

wherein, "Y≦0" in the above table means that pressing of the top front roller may be effected either simultaneously with the restarting of the drafting rollers, or prior thereto, i.e., with a negative lag of time.

In the above Case 3 wherein the back pair of drafting rollers is used as the reference pair, the sliver is attenuated properly into a fleece in the drafting zone between the nips of the back and middle pairs of rollers, but no drafting is exerted on the fleece in the subsequent drafting zone between the nips of the middle and front pairs, thus allowing the fleece having insufficient draft or relatively thick fleece to be fed to the front drafting rollers and therefore into the false-twisting nozzle. Therefore, it is desired that the thick portion of the fleece end should be removed and disposed of immediately after it has come out from the front rollers by using any suitable means such as a pneumatic clearer so that only fleece of the desired draft may be introduced into the false-twisting nozzle for avoiding formation of a knot-like pieced-up joint in the spun yarn.

As is now apparent from the foregoing, according to the method of yarn piecing of the present invention, because the broken fleece end to be lapped over the broken yarn end for piecing by a splicing method can be prepared at a predetermined position, the lapse of time before the nip point of the front pair of drafting rollers is reached by the fleece end, whose travel is initiated by rotating the previously-stopped drafting rollers, is predictable, so that the fleece end may overlap with the yarn end which is previously reserved adjacently to the front pair of rollers over the desired length of overlap. In addition, because the fleece end has its fibers arranged uniformly and straight in a way desirable for yarn piecing by splicing, the joint formed thereby can be made inconspicuously. Thus, good quality yarn may be produced according to the method of the present invention.

Figure 2:
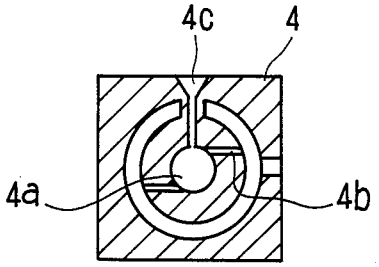
FIG. 2 is a transverse sectional view of a false-twisting nozzle which may be used in the spinning unit of FIG. 1.

While the invention has been illustrated and described with reference to preferred embodiments thereof, it is to be understood that various changes in the details may be made without departing from the spirit and scope of the invention. For example, though in the above-described preferred embodiment the broken end of the yarn is introduced from the outlet opening of the fiber passage channel 4*a* of the false-twisting nozzle 4 to the opposite inlet opening thereof by reversing the yarn from the package P, the yarn may be introduced into the channel through a slit opening 4*c* which is formed in the nozzle extending to the passage 4*a* as shown in FIG. 2.

What is claimed is:

1. A method of yarn piecing in a fasciated yarn spinning unit comprising a fiber drafting device having aligned plural pairs of top and bottom drafting rollers providing a fiber drafting path, a false-twisting nozzle for receiving drafted fiber or fleece from said drafting device and having a fiber passage channel extending therethrough in which said fleece is false-twisted, while it is moved forward in said channel, into a strand of spun yarn to be wound up on a driven yarn package, said drafting device including a driven front pair of drafting rollers and at least one driven back pair of drafting rollers whose nips engage said fleece and impart forward movement thereto towards said front pair of rollers, at least either of the top and bottom rollers of said front pair being liftable from the other of the pair, said method comprising the steps of:

stopping one of said pairs of drafting rollers in response to a break in the spun yarn to stop said fleece movement through said nip thereof, whereby the fleece is broken off to provide a stationary broken end of the fleece at a location just forward of the nip; and moving the liftable roller of said front pair of drafting rollers to separate the pair;

picking up the broken end of said spun yarn from said yarn package and passing the yarn in reverse direction through said fiber passage channel of said false-twisting nozzle and then through the gap formed between said separated front pair of drafting rollers while driving said yarn package in reversed direction, to position said yarn broken end at a location displaced from said fiber drafting path and spaced a predetermined distance rearwardly from the location of said nip of said front pair of drafting rollers to thereby provide a predetermined piecing length of spun yarn extending outside of said fiber drafting device;

restarting the previously stopped drafting rollers to again move said fleece in said forward direction; and returning the liftable roller of the front pair of drafting rollers to its original position in engagement with the other of the pair to restart said front pair of drafting rollers to move said piecing length of spun yarn in said forward direction through said front pair of drafting rollers only after said broken end of said moving fleece has reached and is between said nip of the front pair of rollers, and again driving said yarn package to wind said spun yarn thereon, whereby said piecing length of spun yarn is pieced with said fleece within said false-twisting nozzle.

2. A method of yarn piecing according to claim 1, wherein said piecing length of spun yarn has a length X between its said broken end and said nip of the front pair of drafting rollers when in engagement with each other, and said returning to engagement of said front pair of drafting rollers is effected at a predetermined time Y after said restarting step.

3. A method of yarn piecing according to claim 2, wherein said one pair of stopped drafting rollers is said front pair of drafting rollers, and said length X is within the range of from 2 to 30 cm, while said time Y is zero or less.

4. A method of yarn piecing according to claim 2, wherein said one pair of stopped drafting rollers is said one back pair of drafting rollers immediately preceding said front pair of drafting rollers, and said length X is within the range of from 5 to 100 cm, while said time Y is within the range of from 0 to ½ second.

5. A method of yarn piecing according to claim 2, wherein said one pair of stopped drafting rollers is a second back pair of drafting rollers immediately preceding said one back pair of drafting rollers, and said length X is within the range of from 10 to 500 cm, while said time Y is within the range of from 0 to 3 seconds.

6. A method of yarn piecing according to claim 1, further comprising the step of allowing all of said pairs of drafting rollers to continue to rotate for a predetermined length of time prior to said stopping step.

7. A method of yarn piecing according to claim 6, further comprising the step of removing waste fibers from within the drafting area of said fiber drafting device, said waste removing step being conducted after said stopping step.

8. A method of yarn piecing according to claim 1, wherein said liftable roller is the top roller of said front pair.

* * * * *